US006423160B1

(12) United States Patent
Arimoto et al.

(10) Patent No.: US 6,423,160 B1
(45) Date of Patent: Jul. 23, 2002

(54) STAINLESS STEEL PLATE FOR SHADOW MASK METHOD FOR PRODUCTION THEREOF AND SHADOW MASK

(75) Inventors: Nozomu Arimoto, Osaka; Hayato Kita; Masahiro Aoki, both of Niigata; Shinji Tsuge, Hyogo; Kazuhiko Adachi, Niigata, all of (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/743,067

(22) PCT Filed: May 1, 2000

(86) PCT No.: PCT/JP00/02894

§ 371 (c)(1),
(2), (4) Date: Jan. 4, 2001

(87) PCT Pub. No.: WO00/68449

PCT Pub. Date: Nov. 16, 2000

(30) Foreign Application Priority Data

May 7, 1999 (JP) ..... 11-127702
May 7, 1999 (JP) ..... 11-127704

(51) Int. Cl.[7] ..... C21D 8/02
(52) U.S. Cl. ..... 148/325; 148/610; 148/609
(58) Field of Search ..... 148/325, 610, 148/609

(56) References Cited

FOREIGN PATENT DOCUMENTS

| | | | | |
|---|---|---|---|---|
| JP | 63-219527 | * | 9/1988 | ..... 148/609 |
| JP | 63-255340 | | 10/1988 | |
| JP | 5-195054 | * | 8/1993 | ..... 148/610 |
| JP | 8-127849 | | 5/1996 | |
| JP | 8-188855 | | 7/1996 | |

OTHER PUBLICATIONS

English abstract of Japanese patent 10158788A dated Jun. 16, 1998.*

English abstract of Japanese patent 403297035A dated Dec. 27, 1991.*

* cited by examiner

*Primary Examiner*—Deborah Yee
(74) *Attorney, Agent, or Firm*—Merchant & Gould PC

(57) ABSTRACT

A stainless steel plate for a shadow mask, comprising 9 to 20 weight % of chromium (Cr), 0.15 weight % or less of carbon (C), 0 to 1.0 weight % of manganese (Mn), 0 to 0.2 weight % of titanium (Ti), 0 to 1.0 weight % of silica (Si), and 0 to 1.0 weight % of aluminum (Al); wherein the rest includes ferrite (Fe) and inevitable impurities, and in the inevitable impurities, the content of phosphor (P) is 0.05 weight % or less and the content of sulfur (S) is 0.03 weight % or less. Furthermore, the metal plate for a shadow mask after cold rolling or shape correction is performed is subjected to annealing treatment at the end-point temperature of the plate of 550 to 650° C. This steel plate has a coefficient of thermal expansion smaller than that of low carbon steel and is less expansive than invar alloy. Further, the steel plate has high strength that is acceptable for the shadow mask that is used under conditions where plastic deformation is small at high temperature and high tension is applied. Furthermore, the steel plate has an excellent etching processing property.

12 Claims, 5 Drawing Sheets

STAINLESS STEEL PLATE FOR SHADOW MASK METHOD FOR PRODUCTION THEREOF AND SHADOW MASK

TECHNICAL FIELD

The present invention relates to a stainless steel plate for a shadow mask on which an etching process can be performed excellently and warp does not occur easily and to a method for producing the same.

BACKGROUND ART

The main components constituting a color cathode ray tube of a television receiver include an electron gun, a screen for imaging an electron beam, and a shadow mask as an electrode for selecting colors. In general, the shadow mask uses a thin metal plate of a thickness of 0.3 mm or less on which numerous micro-holes are provided regularly and precisely.

Hitherto, as a material of the metal thin plate for a shadow mask, a low carbon aluminum killed steel (hereinafter low carbon steel will be referred to) has been used.

However, in this material, a long time of irradiation with electron beams due to a continuous use causes a thermal expansion, thus distorting the micro holes provided on the plate. As a result, the misalignment of colors, called a doming phenomenon, occurs so that electron beams passing through the micro-holes are mislocated from the predetermined phosphor dots.

In particular, recently, since a large size and high quality of color television, or high accuracy of personal computer displays are demanded, the above-mentioned doming phenomenon becomes a large problem.

Therefore, for such applications of use, Fe—Ni invar alloy (hereinafter, invar alloy will be referred to), which has a small thermal expansion of about 1/10 of a common steel, has been used widely.

However, since the invar alloy is an expensive metal material, it is not appropriate from the economical viewpoint.

On the other hand, recently, a flat television in which an image appears on a display screen apparently and is recognized visually has been given attention.

In this method, since a shadow mask is incorporated into a cathode ray tube so that a shadow mask is held with tension applied, the deformation of the shadow mask due to the thermal expansion can be prevented. Therefore, in the material having a coefficient of thermal expansion larger than that of the conventional invar alloy, the doming phenomenon does not easily occur.

However, on the contrary, since high tension is applied to the shadow mask itself, a metal material with high strength is required.

When the shadow mask is incorporated into the cathode ray tube, the shadow mask is subjected to a heating process of about 500° C. with tension applied. Therefore, the shadow mask is required to be produced of a material that is not deformed easily at high temperature.

Furthermore, since a low carbon steel or invar alloy, which has been used conventionally, is poor in corrosion resistance and easily rusts, such materials have to be stored generally in a state where they are coated with a rust-preventive agent. Therefore, a material for a shadow mask that does not form rust easily and has an excellent corrosion resistance even during storage has been highly demanded.

Moreover, JP63-255340A proposes an Fe-based material including 1.0 to 4.0% of Cu (hereinafter, component rate is expressed by %, and % means weight % unless otherwise noted) as a material for a flat tension shadow mask having a high proof strength so that deformation does not occur easily at the time of fabrication or in use and sufficient elastic stretchability so that plastic deformation does not occur due to the thermal distortion in use.

However, although this metal material has 0.2% proof strength of 50 kgf/mm$^2$ (490 MPa) or more, the coefficient of thermal expansion is substantially the same as that of low carbon steel. Therefore, this material cannot prevent the doming phenomenon sufficiently.

Furthermore, this material has a corrosion resistance substantially the same as that of low carbon steel or invar alloy, and likewise requires coating with rust-preventive agent during the storage.

However, in order to provide micro-holes on a metal thin plate for a shadow mask, it is common to employ a photo-etching process utilizing a corrosion melting phenomenon of the metal. The photo-etching process is carried out by:

(a) degreasing and washing a metal thin plate to form a photosensitive photoresist film on the surface of the metal thin plate and thermosetting a predetermined pattern;

(b) then developing this pattern into the intended form of photoresist patterns;

(c) spraying a solution of ferric chloride on the surface of the metal thin plate on which the photoresist patterns are developed and melting an exposed metal part so as to provide micro-holes; and (d) finally removing the photoresist film.

Thus, the intended shadow mask can be obtained. However, in the process in which the metal thin plate is subjected to corrosion melting by the etching process, as shown in a cross section in FIG. 1, corrosion in the side direction, called side etching (S), simultaneously proceeds in addition to the corrosion in the depth (D) direction. In FIG. 1, reference numeral 1 denotes a metal thin plate, 2 denotes a photoresist film, and 3 denotes an etched hole.

Herein, a value obtained by dividing the etching depth (D) by side etching (S) is called an etching factor.

Namely, in the schematic view of the etched cross section of FIG. 1, the etching factor (EF) is represented by the following formula 1:

$$EF=D/S=D/[(W-M)/2] \quad \text{(formula 1)}$$

wherein

M: width of pattern of the photoresist film

W: width of groove after etching process

S: side etching

D: depth after etching process.

In order to provide micro-holes as on a shadow mask by the photo-etching process, the above-mentioned side etching should be as little as possible. Therefore, it is desirable that a metal material has a large etching factor (EF).

Furthermore, if there is a large amount of inclusions in the steel, when the etching process is performed, the neighborhood of the inclusion is nonuniformly dissolved, thus making the porous shape irregular. Therefore, when such a metal is used, it is difficult to provide micro-holes as on a shadow mask. Therefore, it is a necessary condition as a material for a shadow mask that a material includes as few inclusions as possible.

A metal thin plate that is a material for a shadow mask is generally produced by forming a material metal into a plate material, and cold rolling and annealing of the plate material. Since the annealing state may be insufficient in mechanical strength, it is common to perform temper rolling.

Furthermore, the flatness is poor in the metal plate that is subjected to the temper rolling, uniform tension cannot be applied to the plate and the plate is wrinkled. In such a case, occasionally, in order to correct the plate shape, bending and restoring are done repeatedly so as to carry out the shape correction (tension level controller) of the plate.

However, in the metal plate that is subjected to the cold rolling or shape correction as mentioned above, although the plate appears flat, warp occurs as the removal of the plate thickness from one side of the plate by etching process (half etching) proceeds.

In particular, in the metal plate after its shape are corrected, although the flatness is improved as compared with the plate which no processing is performed after cold rolling, the warp may be larger at the time of etching process.

Namely, micro-holes provided on the shadow mask is designed to have a small apertured portion (small hole 4) at the side of the electron gun (the side where electron beams enter), and a large apertured portion (small hole 5) at the side of the phosphor screen (the side where electron beams are emitted), so that the electron beams are introduced into the predetermined phosphor screen exactly. However, when micro-holes are provided on the metal plate for a shadow mask produced by a cold rolling such as a temper rolling or a shape correction in accordance with a usual method of etching process, warp tends to occur disadvantageously.

If the shadow mask warps, the disadvantage in working occurs, for example, bending in handling etc. easily occurs during handling, or it is necessary to include a step for modifying the warp shape when masks are set.

As the effective means for preventing warp generated when asymmetric etching processes are performed with respect to a rear side and a front side of the metal plate, for example, annealing treatment of a metal plate after the cold rolling is performed at the temperature below the softening temperature with tension of yield point or less applied (so-called, a tension anneal method) is well known. According to this method, it is possible to correct the flatness of the steel belt and at the same time to reduce the residual stress.

However, the tension anneal method requires an apparatus for applying tension or equipment resistant to the high tensile strength. Therefore, expensive and specifically designed equipment is required.

Therefore, a method for producing a metal plate for a shadow mask in which warp dose not occur after the etching process has been demanded.

On the other hand, a material of the metal plate for a shadow mask has been mainly a low carbon steel plate (low carbon aluminum killed steel), however, in this material, a long time of irradiation with electron beams due to a continuous use causes a thermal expansion, to thus distort the micro holes provided on the plate. As a result, the misalignment of colors called a doming phenomenon occurs so that electron beams passing through the micro-holes are mislocated from the predetermined phosphor dots.

Therefore, invar alloy (Fe—Ni invar alloy) having a small thermal expansion (about 1/10 as that of common steel) has been used as a shadow mask. However, this invar alloy is expensive, so that it is not appropriate from the economical viewpoint.

Furthermore, a flat television in which an image appears on a display screen apparently and recognized visually has been given attention. In this method, since a shadow mask is incorporated into a cathode ray tube so that a shadow mask is held with tension applied, the deformation due to thermal expansion can be prevented. Further, even in the material having a larger thermal expansion than the conventional invar alloy, it is advantageous that the doming phenomenon hardly occurs. However, on the contrary, since high tension force is applied to the shadow mask itself, a metal material with high strength is required. Furthermore, when the shadow mask is incorporated into the cathode ray tube, the shadow mask is subjected to a heating process of about 500° C. with tension applied. Therefore, the shadow mask is required to be formed of a material that is not plastic deformed easily at high temperature.

Furthermore, since the conventionally used low carbon steel or invar alloy is sufficient in corrosion property and easy to form rust, such materials have to be generally stored in state where they are coated with a rust- preventive agent. Therefore, a material for a shadow mask, which does not easily form rust when it is stored and is excellent in corrosion resistance, has been high demanded.

Moreover, JP63-255340A suggests a metal material including 1.0 to 4.0% of Cu and the rest including Fe and inevitable impurities as a material for a flat tension shadow mask having a high proof strength in which deformation does not occur during the fabrication or in use and sufficient elastic stretchability in which plastic deformation does not occur due to the thermal distortion in use. Although this material is characterized in that the 0.2% proof strength is 50 $kgf/mm^2$ (490 MPa) or more, the coefficient of thermal expansion is substantially the same as that of low carbon steel plate. Therefore, the doming phenomenon cannot suppress sufficiently. Furthermore, the corrosion property is the same as that of low carbon steel or invar alloy. Also this material needs to be coated with the rust-preventive oil during the storage.

Of course, in a metal plate for a shadow mask on which micro-holes are provided by the photo-etching method, the above-mentioned side etching should be as small as possible. Accordingly, as mentioned above, a metal material having a large etching factor (EF) is desirable.

Furthermore, if there is a large amount of inclusions in metal material, when the etching process is performed, the parts around the inclusions are nonuniformly melted, and thus the hole shapes are irregular. Thus, it is difficult to perform micro-holes. Therefore, a material including extremely few inclusions is also desirable for the material for a shadow mask.

Under such circumstances, there has been increasing demand for a metal plate for a shadow mask in which the coefficient of thermal expansion is smaller than that of the low carbon steel plate material, the price is less expensive than the invar alloy material, the amount of plastic deformation is small at high temperature, mechanical strength is so excellent that the plate can be used for a shadow mask used with high tension applied and furthermore, etching property is excellent.

DISCLOSURE OF THE INVENTION

It is therefore an object of the present invention to provide a stainless steel plate for a shadow mask in which the coefficient of thermal expansion is smaller than that of the low carbon steel plate material, the price is less expensive than the invar alloy, the amount of plastic deformation is small at high temperature, and mechanical strength is sufficiently high so that the plate can be used for a shadow mask used with high tension applied, further the etching property is excellent, and the shape is stable after the etching process; a method for producing the same; and a shadow mask.

The present inventors intensively investigated and found that when the specified amount of Cr, a small amount of C, a small amount of Mn, Ti, Si or Al if necessary, are contained in Fe, and the contents of inevitable impurities P and S are set to be low, it is possible to obtain a stainless steel suitable for a shadow mask material, in which the coefficient of thermal expansion is small, and mechanical strength, etching property, and corrosion resistance property are excellent.

Furthermore, it is possible to obtain the following findings (a) to (c).

(a) In a metal plate that is subjected to cold rolling such as temper rolling, since the surface predominantly is stretched by a roller, stretching stress is accumulated on the surface layer of the metal plate as an internal stress. Furthermore, also in a metal plate that is subjected to the shape correction by a tension level controller, etc., a compressive stress is accumulated on the surface of the metal plate due to the bending and restoring process. As mentioned above, in the metal plate on which the internal stress is accumulated, although the plate appears flat, warp occurs as the plate thickness is removed from one side of the plate by etching (half etching). Because of the loss, the stress corresponding to the melted and released plate thickness, thus the stress of the front surface and rear surface get out of balance, which may be lead to warp on the plate. In particular, as explained in FIG. 2, micro-holes provided on the metal plate for a shadow mask is designed to have a small apertured portion on one side, and a large apertured portion on the other side. Therefore, in order to provide such micro-holes, a metal plate for a shadow mask that is subjected to cold rolling such as temper rolling or shape correction is etched, and the amount of the accumulated stress due to melting becomes asymmetric between the large apertured portion and the small apertured portion. Consequently, the stress gets out of balance, thus to generate a remarkable warp.

(b) However, even in the metal plate for a shadow mask that is subjected to cold rolling such as temper rolling or shape correction and in which the internal residual stress is accumulated, when the metal plate is annealed at a low temperature before a recrystallization, the internal residual stress is sufficiently relaxed. Therefore, warp does not occur even if the micro-holes asymmetric between the front side and the rear side are provided by an etching process. Furthermore, the mechanical strength necessary to the shadow mask is not affected.

(c) Furthermore, as a metal plate for a shadow mask, a stainless steel containing the specified amount of Cr, a small amount of C, and a small amount of Mn, Ti, Si or Al, if necessary, and setting the contents of inevitable impurities P and S to be low is employed, it is possible to obtain a material for a shadow mask having a small coefficient of thermal expansion and excellent mechanical strength, etching property (fine etching process, uniformity of hole shape) and corrosion resistance.

The present invention is completed based on the above-mentioned findings. According to the present invention, a stainless steel plate for a shadow mask includes 9 to 20 weight % of chromium (Cr), 0.15 weight % or less of carbon (C), 0 to 1.0 weight % of manganese (Mn), 0 to 0.2 weight % of titanium (Ti), 0 to 1.0 weight % of silica (Si), and 0 to 1.0 weight % of aluminum (Al); wherein the rest includes ferrite (Fe) and inevitable impurities, and in the inevitable impurities, the content of phosphor (P) is 0.05 weight % or less and the content of sulfur (S) is 0.03 weight % or less.

Furthermore, according to the present invention, a method for producing a stainless steel plate for a shadow mask including 9 to 20 weight % of chromium (Cr), 0.15 weight % or less of carbon (C), 0 to 1.0 weight % of manganese (Mn), 0 to 0.2 weight % of titanium (Ti), 0 to 1.0 weight % of silica (Si), and 0 to 1.0 weight % of aluminum (Al); wherein the rest includes ferrite (Fe) and inevitable impurities, and in the inevitable impurities, the content of phosphor (P) is 0.05 weight % or less and the content of sulfur (S) is 0.03 weight % or less, includes annealing the metal plate for a shadow mask after cold rolling or shape correction is performed at the end-point temperature of the plate of 550 to 650° C.

BRIEF DESCRIPTION OF DRAWINGS

In FIGS. 1 to 5, reference numeral 1 denotes a metal plate, 2 denotes photoresist film, 3 denotes an etched hole, 4 denotes aperture (small hole), 5 denotes aperture (larger small hole), 6 denotes an etching surface, 7 denotes a sealed surface, 11 denotes a color cathode ray tube, 12 denotes a face panel, 12*a* denotes a phosphor screen, 13 denotes a funnel, 13*a* denotes a neck portion of the funnel, 14 denotes an electron gun, 15 denotes a deflection yoke, 16 denotes a shadow mask, 17 denotes a mask frame, 18 denotes a slot hole, and 19 denotes a bridge.

BEST MODE FOR CARRYING OUT THE INVENTION

Figure 1:
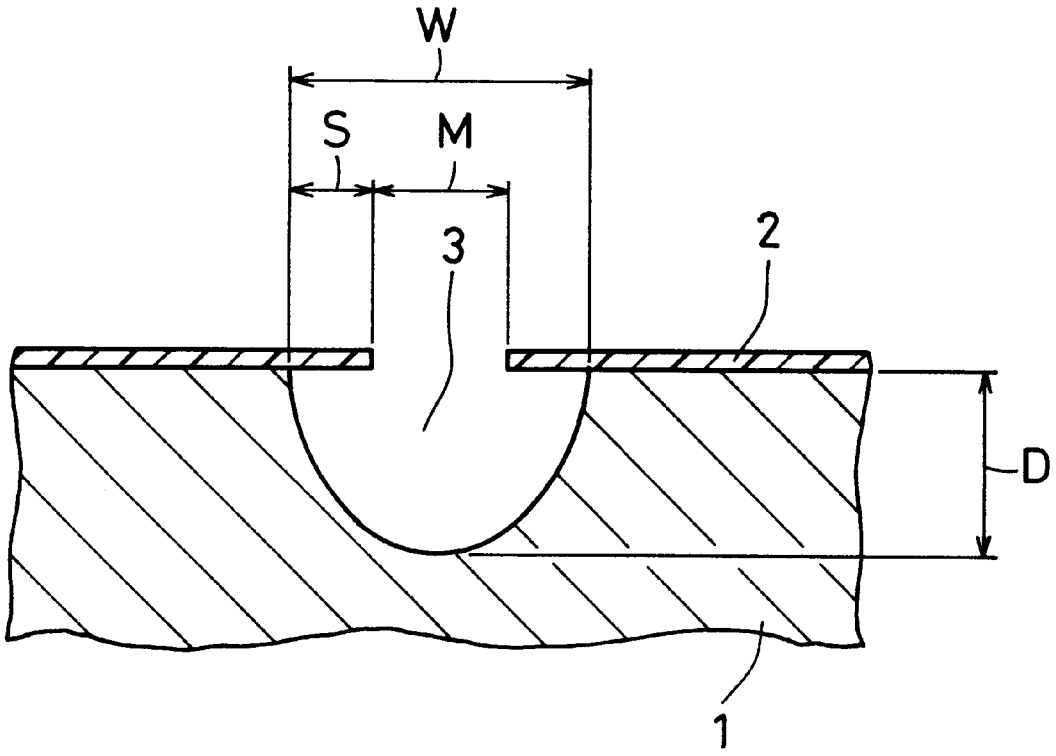
FIG. 1 is a schematic view showing a cross section of a metal plate in which a general photo-etching process is performed.
Figure 2:
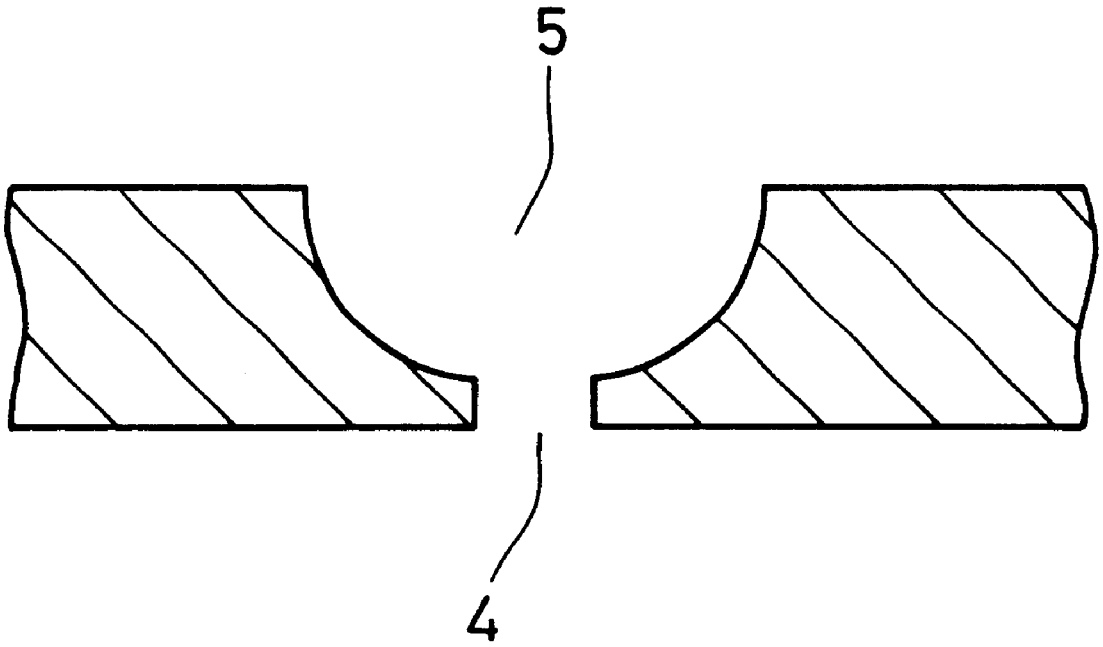
FIG. 2 is a schematic view showing a cross section of a general shadow mask.

The following are explanations of the reason why the chemical composition of the stainless steel plate for a shadow mask of the present invention is defined as mentioned above, along with the effects of the compositions.

(a) Chromium (Cr)

Chromium has an effect of reducing the coefficient of thermal expansion and improving the corrosion resistance of the steel plate. As Cr content is increased, the coefficient of thermal expansion of the steel plate is reduced and thus the corrosion resistance is improved. However, when the Cr content is less than 9%, the coefficient of thermal expansion is substantially the same as that of a low carbon steel plate. Therefore, the doming phenomenon cannot be suppressed sufficiently. Furthermore, in this case, there is a problem in that a sufficient corrosion resistance of the steel plate cannot be obtained, so that the plate is likely to rust during storage.

On the other hand, as Cr content is increased, an etching factor tends to be lowered. In particular, when Cr content is more than 20%, the plate is not suitable for a shadow mask in which the precise etching process is required. Furthermore, when Cr content is more than 20%, the melting rate of the etching process is extremely reduced, thus deteriorating the productivity in the etching process.

For such reasons, the Cr content is defined to be 9 to 20%. However, the desirable Cr content is 9 to 13% because when Cr content is increased, hot process performance is lowered, thus deteriorating the productivity in etching process, and Cr itself is a relatively expensive material.

(b) Carbon (C)

Only a small content of C can provide the steel plate with an effect of improving the strength (particularly high temperature strength). Thus, it is possible to make the steel plate thin by including C.

Moreover, the increase in C content causes the deterioration of an etching factor. However, since the steel plate is made thin, etching is finished fast. As long as C content falls within the range set in the present invention, i.e. 0.15% or less, it is sufficiently possible to provide micro holes without inconvenient side etching.

However, if C content is more than 0.15%, the etching factor is lowered extremely, so that the plate is not suitable for producing a shadow mask.

Therefore, the upper limit of C content is set to be 0.15%. However, particularly when a highly precise shadow mask having holes with small diameter is produced, C content desirably is set to be 0.05% or less. Furthermore, from the viewpoint of the strength, for a shadow mask with high tension applied, it is desirable to secure more than 0.003% of C content.

(c) Manganese (Mn)

Mn is a component added if necessary for deoxidation of a molten steel. In particular, when Mn is present together with Si, the deoxidation effect is enhanced. When Mn content is more than 1.0%, the steel plate is hardened so as to lower the processing property. In addition, it is disadvantageous from the economical viewpoint. Therefore, Mn content is set to be 0 to 1.0%.

(d) Titanium (Ti)

Ti has an effect of improving the processing property and corrosion resistance of the steel plate. Therefore, Ti may be added if necessary, when more excellent processing property or corrosion resistance is required. However, when an excessive content of Ti is present, non-metal inclusions are increased, so that uniform hole shape cannot be obtained. Therefore, the Ti content is set to be 0 to 0.2%.

(e) Silica (Si)

Si is a component added if necessary for deoxidation of a molten steel. However, an excessive content of more than 1.0% makes the steel harden and to become brittle, and thus the steel plate becomes an inappropriate material for shadow mask. Therefore, Si content is set to be 0 to 1.0%.

(f) Aluminum (Al)

Also Al is a component added if necessary for deoxidation of a molten steel. However, if an excessive content of Al is added, non-metal inclusions are increased. The circumference of the inclusions may be nonuniformly and excessively melted during the etching process. Therefore, Al content is set to be 0to 0.1%.

(g) Phosphorus (P) and sulfur (S)

P and S are impurity elements included in a steel plate. When a large amount of P and S are contained, non-metal impurities are generated, from which nonuniform etching is initiated. Therefore, in order to suppress the level of the above-mentioned disadvantages to be as low as possible, P content is set to be 0.05% or less and S content is set to be 0.03% or less, respectively.

Moreover, the above-mentioned stainless steel for a shadow mask according to the present invention can be produced by a general production process for a stainless steel plate.

Namely, first, the molten steel is adjusted to have the above-mentioned components by a VOD method (Vacuum Oxygen Decarburization method. This method is a vacuum decarbonization method using the principle in which C is predominantly oxidized with respect to Cr by a reducing pressure. Industrially, the method is put into actual use by co-development of Witten and Standard Messo in 1967) or an AOD method (Argon Oxygen Decarburization method. In this method, an inert gas (Ar or $N_2$) together with oxygen gas are blown into a molten steel plate, thus to carry out decarbonization efficiently with suppressing the oxidization of valuable metal by reducing the partial pressure of generating CO gas. This method was developed by W. Krivsky of Union Carbide in 1954 and put into actual used by Joslyn Steel Company in 1968.). Then, the above-mentioned molten steel cast by continuous casting or ingot-making method. The cast product is subjected to hot rolling. Next, in order to remove oxidation scale and defects on the surface, pickling treatment is performed. The resultant product is subjected to cool rolling and annealing treatment repeatedly. A temper rolling is carried out if necessary to produce a stainless steel thin plate having a desired plate thickness and strength.

In order to improve the strength of the plate at room temperature and high temperature, about 500° C. or less, it is effective to add the strengthening method in which a structure consisting of ferrite and martensitic steel is obtained by generating martensitic steel by quenching process.

As mentioned above, a stainless steel plate containing 9 to 20% of Cr, has a coefficient of thermal expansion lower than that of conventional low carbon aluminum killed steel. Furthermore, the coefficient of thermal expansion of the shadow mask using the stainless steel plate of the present invention is closer to that of the phosphor glass constituting a color cathode ray tube, that is, 9.1 to $9.8\times10^{-6}$/° C., and thus plastic deformation is lowered. Therefore, together with the effect of the tension strength, relative displacement is reduced, thus reducing the doming phenomenon.

Furthermore, the stainless steel plate of the present invention has a higher mechanical strength compared with the plate material of the conventional low carbon steel or invar alloy, it is possible to realize a thin shadow mask, which is excellent as a material for a shadow mask with high tension applied.

Furthermore, in the stainless steel plate of the present invention, by regulating the contents of Cr and C within the certain range, a precise etching process can be realized without extremely deteriorating the etching factor. Furthermore, the content of small amount of elements is determined, and the inclusions are reduced, thus suppressing non-uniform etching melting in the vicinity of inclusions and to perform the uniform etching.

Moreover, the stainless steel plate of the present invention is more excellent in corrosion resistance as compared with the conventionally used low carbon stainless steel plate or invar alloy. And it is advantageous because it is not necessary to coat with a rust-preventive oil during storage.

The following is an explanation of the method of the present invention. The material of the metal plate for a shadow mask used in the method of the present invention is not particularly limited. Any materials for a shadow mask, for example, low carbon steel, invar alloy, Cu—Fe ally, etc. may be used in order to produce stably a metal plate for a shadow mask in which warp is not generated after etching process. However, when the stainless steel plate of the item 2 of the present invention is applied, a high performance shadow mask metal plate can be obtained.

The following is an explanation of the reason why the temperature of the shadow mask at the time of annealing treatment after the shadow mask is subjected to cold rolling (temper rolling or the like) or shape correction, the chemical composition of the stainless steel plate for a shadow mask of the present invention is determined as mentioned above, along with the effects of the composition.

[A] Annealing Temperature

As mentioned above, in a metal plate for a shadow mask that is subjected to cold rolling such as temper rolling etc. or shape correction by the use of, for example, a tension level controller etc., strong internal residual stress is accumulated. This causes warp with asymmetric micro-holes having different diameters between the rear side and front side for electron beams' passing through. Although the annealing has not been given attention because the mechanical strength is damaged, the annealing treatment is performed at low temperatures, 550 to 650° C., particularly before the temperature causing the recrystalization. Thus, the mechanical strength necessary to the shadow mask is not damaged, and the internal residual stress is relaxed. And even if the asymmetric micro-holes are provided on the rear side by an etching process, warp does not occur.

Moreover, when the annealing temperature is less than 550° C., the residual stress is not sufficiently released, and the warp preventing effect cannot be obtained. On the contrary, when the plate temperature is more than 650° C., metal plate starts to be softened or recrystalized, it is not possible to maintain the mechanical strength necessary to the shadow mask to which high tension is applied. Therefore, the annealing temperature is 550 to 650° C. for the end-point temperature of the plate, however, in order to reduce the warp, the temperature is desirably 600° C. or more.

The annealing time may be about 30 seconds after the plate temperature reaches 550 to 650° C. However, too long retention time may cause the softening of the material. Therefore, practically, it is preferable that the retention time is about 10 minutes.

Herein, needless to say, the annealing conditions are applied to any of the conventionally known materials such as low carbon steel, invar ally, Cu—Fe ally, or stainless steel material for shadow mask used in the present invention.

When the shadow mask is incorporated into a cathode ray tube, a heating history at about 500° C. is performed with tension applied. Therefore, there is a concern that the tension may be relaxed in accordance with the plastic deformation at high temperature. However, with the shadow mask produced by the method according to the present invention, annealing treatment is carried out at 550 to 650° C., and even if the tension is applied, as long as it is heated at lower temperature than the annealing temperature, plastic deformation does not occur, and the provided tension is maintained.

Moreover, the annealing treatment can be carried out easily by using a bright annealing furnace that is used for producing stainless steel belt. Therefore, treatment cost is not so particularly increased.

Figure 4:
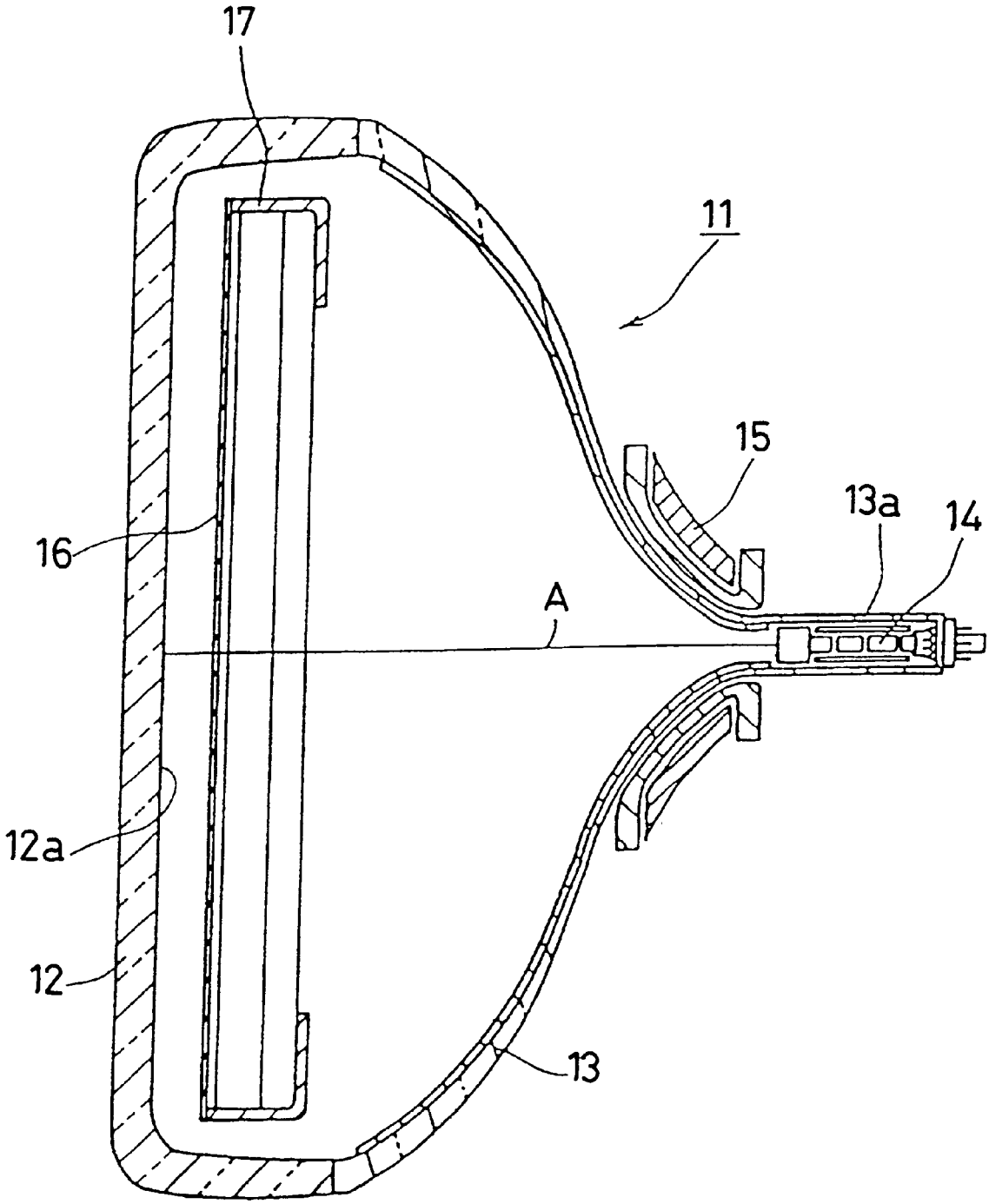
FIG. 4 is a sectional view showing one example of the color cathode ray tube in which a shadow mask is incorporated in one embodiment according to the present invention.

FIG. 4 is a sectional view showing one example of the color cathode ray tube in which a shadow mask is incorporated in one embodiment according to the present invention. In FIG. 4, the color cathode ray tube 11 includes a substantially rectangular face panel 12, the inner surface of which is provided with a phosphor screen 12*a,* a funnel 13 connected behind the face panel 12, an electron gun 14 incorporated into a neck portion 13*a* of the funnel 13, a shadow mask 16 provided inside the face panel 12 opposing the phosphor screen 12*a* and a mask frame 17 fixing the shadow mask 16. Furthermore, in order to perform the deflection scanning of the electron beam, a deflection yoke 15 is provided on the outer circumference of the funnel 13.

The shadow mask 16 plays a role of selecting colors with respect to three electron beams emitted from the electron gun 14. Mark A shows an electron beam track.

Figure 5:
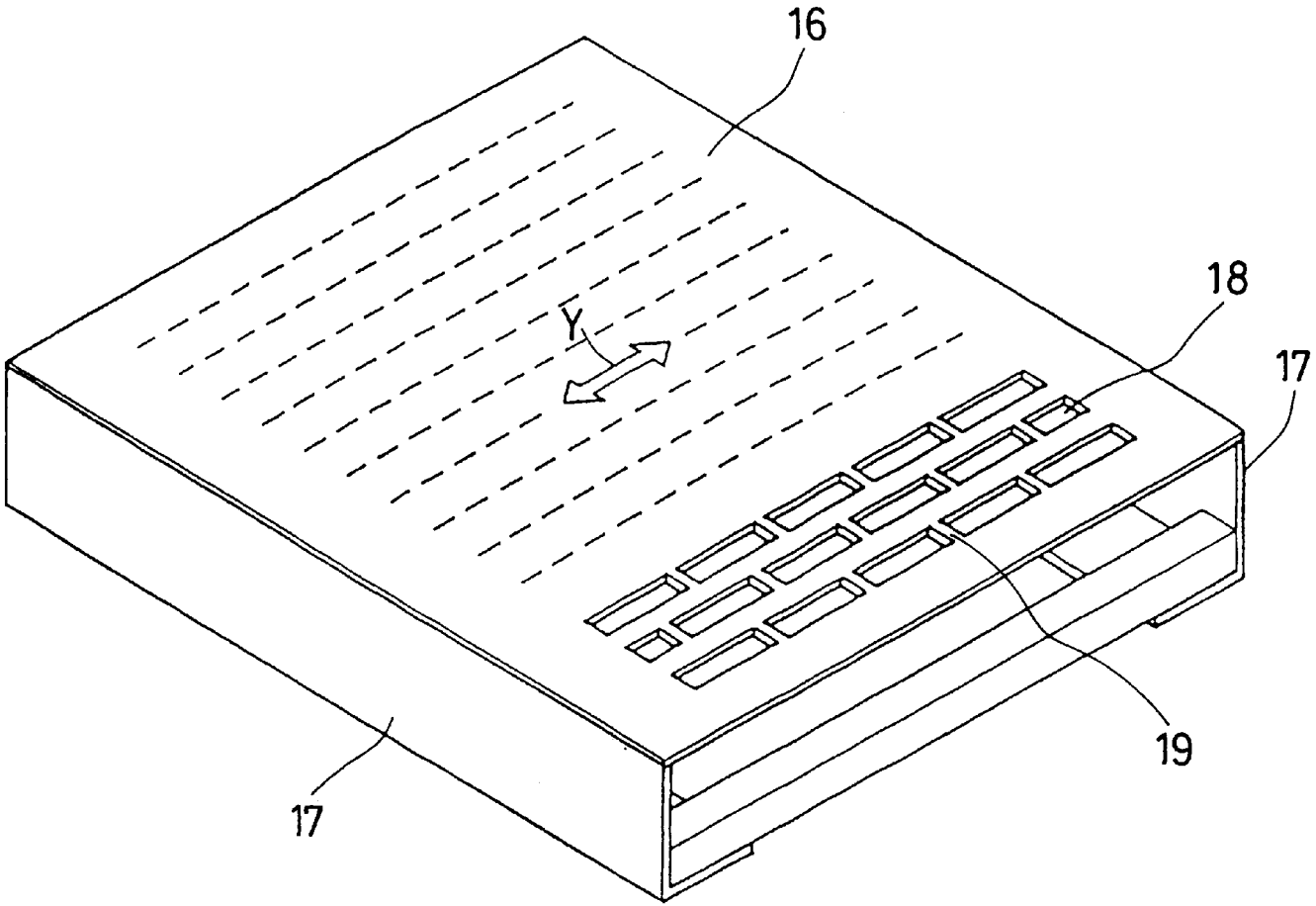
FIG. 5 is a perspective view showing a slot type shadow mask in one embodiment according to the present invention.

FIG. 5 shows an example in which the shadow mask 16 of this example is processed into a slot type shadow mask. FIG. 5 is a perspective view showing a slot type shadow mask, wherein a large number of substantially rectangular electron beam through holes, that is, slot holes 18, are provided by etching. The direction shown by an arrow y is the vertical direction of the screen. Slot holes 18 are formed in a constant longitudinal pitch. Numeral 19 denotes a bridge that is a portion between slot holes.

Next, the present invention will be specifically described with reference to Examples.

EXAMPLE 1

First, in accordance with a common method, a steel plate of the present invention having chemical compositions shown in Table 1 and a low carbon steel plate and invar ally steel plate (both were cool rolled plate having a thickness of 0.15 mm), which are conventionally used for shadow mask materials, were obtained.

TABLE 1

| | Chemical Components (weight %) | | | | | | | | | | |
|---|---|---|---|---|---|---|---|---|---|---|---|
| | C | Si | Mn | P | S | Ni | Cr | Ti | sol. Al | N | *1 |
| Steel plate*3 | 0.024 | 0.40 | 0.54 | 0.017 | 0.012 | 0.24 | 11.8 | 0.016 | 0.003 | 0.016 | *2 |
| Low carbon steel plate | 0.004 | 0.04 | 0.24 | 0.03 | 0.020 | — | — | — | 0.06 | 0.011 | *2 |
| Invar ally | 0.003 | 0.02 | 0.27 | 0.005 | 0.010 | 36.2 | 0.02 | 0.016 | 0.004 | 0.001 | *2 |

*1 = Fe and other inevitable impurities

*2 = rest

*3 = Steel plate of the present invention

Next, these cold metal rolled plates of metal are processed by temper rolling at the processing rate shown in Table 2, respectively. The coefficient of thermal expansion and 0.2% proof strength of the resultant thin plate materials were examined.

Table 2 also shows these results. Moreover, the coefficient a of thermal expansion is an average value from values at 20 to 100° C.

TABLE 2

| | Cold rolling rate (%) | Coefficient of thermal expansion (× $10^{-6}$/° C.) | 0.2% proof strength (MPa) Room temperature | 0.2% proof strength (MPa) 450° C. |
|---|---|---|---|---|
| Steel plate of the present invention | 20 | 10.5 | 550 | 440 |
| Low carbon steel | 20 | 11–12 | 500 | 350 |
| Invar alloy plate | 16 | 2 or less | 400 | 240 |

As is apparent from the results shown in Table 2, the coefficient of thermal expansion of the steel plate of the present invention is smaller than that of low carbon steel plate and close to the value of the phosphor glass, i.e. 9.1 to $9.8\times10^{-6}$/° C.

Furthermore, 0.2% proof strength of the steel plate of the present invention at room temperature is higher than that of low carbon steel plate or invar alloy plate.

Furthermore, since the 0.2% proof strength of the steel plate of the present invention at 450° C. is also high, plastic deformation does not occur even after the thermal history when the shadow mask is incorporated.

EXAMPLE 2

Steels having various chemical compositions were subjected to vacuum ingot and casting, and the plates were subjected to hot rolling and pickling, then further cold rolling and annealing treatment repeatedly. Thus, cold-rolled steel plates each having a thickness of 0.15 mm were obtained.

Then, these plates were subjected to temper rolling so as to be formed into a cold-rolled steel plate having a final thickness of 0.12 mm.

Table 3 shows the chemical compositions of the thus cold-rolled steel plate.

TABLE 3

| | Chemical composition (weight %) | | | | | | | | | | |
|---|---|---|---|---|---|---|---|---|---|---|---|
| *1 | C | Si | Mn | P | S | Ni | Cr | Ti | sol. Al | N | #2 |
| A | | | | | | | | | | | |
| 1 | 0.035 | 0.40 | 0.54 | 0.017 | 0.021 | 0.24 | *0.02 | 0.011 | 0.003 | 0.020 | #3 |
| 2 | 0.028 | 0.41 | 0.52 | 0.025 | 0.025 | 0.26 | *2.4 | 0.018 | 0.004 | 0.017 | #3 |
| 3 | 0.037 | 0.44 | 0.42 | 0.024 | 0.011 | 0.23 | *6.2 | 0.016 | 0.004 | 0.014 | #3 |
| B | | | | | | | | | | | |
| 4 | 0.030 | 0.43 | 0.52 | 0.021 | 0.024 | 0.24 | 9.1 | 0.021 | 0.004 | 0.034 | #3 |
| 5 | 0.024 | 0.40 | 0.54 | 0.017 | 0.012 | 0.24 | 11.8 | 0.016 | 0.003 | 0.016 | #3 |
| 6 | 0.046 | 0.44 | 0.56 | 0.018 | 0.014 | 0.23 | 14.6 | 0.031 | 0.003 | 0.015 | #3 |
| 7 | 0.026 | 0.43 | 0.44 | 0.017 | 0.012 | 0.19 | 18.4 | 0.019 | 0.004 | 0.024 | #3 |
| 8 | 0.031 | — | — | 0.021 | 0.018 | 0.21 | 11.9 | — | — | 0.021 | #3 |
| 9 | 0.028 | 0.46 | 0.53 | 0.018 | 0.022 | 0.24 | 11.7 | — | — | 0.018 | #3 |
| C | | | | | | | | | | | |
| 10 | 0.046 | 0.48 | 0.48 | 0.016 | 0.024 | 0.27 | *23.4 | 0.027 | 0.003 | 0.036 | #3 |
| 11 | 0.041 | 0.43 | 0.41 | 0.019 | 0.019 | 0.22 | *27.3 | 0.016 | 0.003 | 0.031 | #3 |
| 12 | 0.039 | 0.47 | 0.54 | 0.022 | 0.016 | 0.24 | *32.1 | 0.010 | 0.004 | 0.018 | #3 |

Note: * shows that the conditions are out of the range determined in the present invention

#1 = kinds of plates

#2 = Fe and other inevitable impurities

#3 = rest

A = Comparative Examples

B = Examples of the present invention

C = Comparative Examples

1–12 = steel plate number

Next, for each of the resultant cold-rolled steel plates (steel plates 1 to 12), the coefficient a of thermal expansion ($\times 10^{-6}$/° C.: an average value at 20 to 100° C.) was measured. At the same time, incidence of the doming phenomenon, etching property (etching processing property), and proof strength were evaluated.

Moreover, in this example, the coefficient α of thermal expansion evaluated by the following indices as the incidence of the doming phenomenon.

○: coefficient α of thermal expansion was less than 10.7

Δ: coefficient α of thermal expansion was 10.7 or more and less 11.0

×: coefficient α of thermal expansion was 11.0 or more

Furthermore, the etching property was evaluated by the following method.

First, the surface of the plate that is degreased and washed was coated with photoresist film to the thickness of 10 μm so as to form a 0.1 mm width groove pattern (M) as shown in FIG. 1. Then, an etching process was performed by spraying a solution of ferric chloride having a specific gravity of 1.48 g/cm$^3$ at the temperature of 50° C. Then, finally, the surface photoresist film was removed. The width (W) and depth (D) of the groove etched on the steel plate were determined and the etching factor (EF) was calculated.

In this example, the etching factor when the etching depth reached 0.06 mm was calculated, and the etching property was evaluated based on the following indices.

○: etching factor (EF) was 2.2 or more

Δ: etching factor (EF) was 1.8 or more and less than 2.2

×: etching factor (EF) was less than 1.8

Then, the proof strength was evaluated by the following method.

The operation in which the cooled rolling plate was immersed in 3% NaCl aqueous solution of 50° C. for 1 hour and then dried for 1 hour was repeated. The repeating time until the cold-rolled steel plate forms rust was counted. The count value was defined as an evaluation standard of the proof strength.

Moreover, in this rusting test, the plate does not form rust after immersing and drying are repeated three times or more, it is judged that the plate does not have problems in terms of the proof strength. Therefore, in this example, the proof strength was evaluated based on the following indices.

○: plate formed rust, after immersing and drying was repeated 3 or more.

×: plate formed rust after immersing and drying was repeated less than 3.

Table 4 shows the resulting evaluation.

TABLE 4

| Plates | Coefficient of thermal expansion: Coefficient of thermal expansion α ($\times 10^{-6}$/° C.) | Coefficient of thermal expansion: Evaluation | Etching property: EF | Etching property: Evaluation | Proof strength: Repeating time | Proof strength: Evaluation |
|---|---|---|---|---|---|---|
| A | | | | | | |
| 1 | 11.5 | x | 2.6 | ○ | 1 | x |
| 2 | 11.3 | x | 2.6 | ○ | 1 | x |
| 3 | 10.9 | Δ | 2.5 | ○ | 2 | x |
| B | | | | | | |
| 4 | 10.6 | ○ | 2.4 | ○ | 4 | ○ |
| 5 | 10.5 | ○ | 2.3 | ○ | 4 | ○ |
| 6 | 10.4 | ○ | 2.3 | ○ | 5 | ○ |
| 7 | 10.4 | ○ | 2.1 | ○ | 7 | ○ |
| 8 | 10.6 | ○ | 2.4 | ○ | 4 | ○ |
| 9 | 10.6 | ○ | 2.3 | ○ | 4 | ○ |
| C | | | | | | |
| 10 | 10.3 | ○ | 1.9 | Δ | 10 or more | ○ |
| 11 | 10.4 | ○ | 1.7 | x | 10 or more | ○ |
| 12 | 10.4 | ○ | 1.5 | x | 10 or more | ○ |

A = Comparative Examples
B = Examples of the present invention
C = Comparative Examples
1–12 = steel plate number As is apparent from the results shown in Table 4, the steel plates 4 to 9 of the present invention have a coefficient of thermal expansion closer to that of the phosphor glass and excellent etching property (etching factor EF) and good proof strength. The result shows that the plates of the present invention are suitable material for a shadow mask.

On the contrary, with steel plates 1 to 3 of Comparative Examples having small content of Cr, a coefficient of thermal expansion is large and furthermore proof strength is poor. Such steel plates are not sufficient materials for a shadow mask.

Steel plates 10 to 12 of Comparative Examples having high content of Cr also are not suitable for etching micro-holes of the shadow mask.

EXAMPLE 3

Steels having chemical compositions shown in Table 5 were subjected to vacuum ingot, respectively. These steels were cast and subjected to hot rolling and pickling, then further subjected to cold rolling and annealing treatment repeatedly. Thus, cold-rolled steel plates each having a thickness of 0.15 mm thickness were obtained.

Then, the thus obtained plates were subjected to a heat treatment for 1 minute at 950° C. Thereafter, furthermore, annealing treatment for removing distortion was performed for 10 minutes at 550° C. Thus, a cold-rolled steel plate (steel plates 13 to 17) were obtained.

TABLE 5

| | Chemical composition (weight %) | | | | | | | | | | | |
|---|---|---|---|---|---|---|---|---|---|---|---|---|
| | C | Si | Mn | P | S | Ni | Cr | Mo | Ti | sol. Al | N | #1 |
| A | | | | | | | | | | | | |
| 13 | 0.003 | 0.45 | 0.25 | 0.015 | 0.004 | 0.05 | 11.4 | 0.01 | 0.16 | 0.045 | 0.006 | #2 |
| 14 | 0.015 | 0.43 | 0.52 | 0.020 | 0.001 | 0.23 | 12.2 | 0.01 | 0.012 | 0.003 | 0.016 | #2 |
| 15 | 0.06 | 0.48 | 0.41 | 0.021 | 0.002 | 0.15 | 12.1 | 0.02 | 0.002 | 0.001 | 0.021 | #2 |
| 16 | 0.13 | 0.32 | 0.32 | 0.015 | 0.001 | 0.18 | 11.7 | 0.02 | 0.001 | 0.001 | 0.009 | #2 |
| B | | | | | | | | | | | | |
| 17 | *0.20 | 0.45 | 0.25 | 0.013 | 0.002 | 0.12 | 12.8 | 0.21 | 0.003 | 0.002 | 0.026 | #2 |

Note: * shows that the conditions are out of range determined in the present invention
#1 = Fe and other inevitable impurities
#2 = rest
A = Examples of the present invention
B = Comparative Examples
13–17 = numbers of steel plates JSI 13B test pieces were cut out of the thus obtained cold-rolled steel plates, respectively, and the strength and stretchability were determined for each piece.

Furthermore, for the resultant cold plates, the etching test was performed similar to the case of Example 2 after descaling. The etching property was evaluated.

Table 6 shows the results.

TABLE 6

| Plates | 0.2% proof strength (MPa) | Tension strength (MPa) | Stretchability (%) | Etching property EF | Etching property Evaluation |
|---|---|---|---|---|---|
| A | | | | | |
| 13 | 205 | 400 | 34 | 2.5 | ○ |
| 14 | 450 | 755 | 12 | 2.3 | ○ |
| 15 | 625 | 985 | 8 | 2.1 | ○ |
| 16 | 1005 | 1276 | 6 | 2.0 | ○ |
| B | | | | | |
| 17 | 1280 | 1450 | 1 | 1.5 | x |

A = Examples of the present invention
B = Comparative Examples
13–17 = numbers of steel plates As in the results shown in Table 6, the steel plates of the present invention 13 to 16 are excellent in strength and etching property. It shows that the plates of the steel plates are acceptable metal materials for shadow mask with high tension applied.

However, in the steel plate 13 (C content was not more than 0.003%), the 0.2% proof strength radically fell short to about 400 MPa. Therefore, there is a concern that state in which high tension is applied cannot be maintained. Also, there is a concern that the plates are not acceptable as the plates material for high tension shadow mask.

Furthermore, the etching factor (EF) of the plate 17 of Comparative Example was extremely small and it was not possible to carry out the highly precise etching process. Therefore, it is apparent also that such a plate is not a sufficient material for the shadow mask.

EXAMPLE 4

The metal plates a-c (stainless steel plate of newly suggested material of the present invention, and steel plates of conventional low carbon plate and conventional invar ally: all plates are cold-rolled steel plates having a thickness of 0.15 mm) and were usual prior art for production process of stainless steel plate.

TABLE 7

| | Chemical composition (weight %) | | | | | | | | | | | |
|---|---|---|---|---|---|---|---|---|---|---|---|---|
| *1 | C | Si | Mn | P | S | Ni | Cr | Ti | sol. Al | N | *2 | *4 |
| a | 0.024 | 0.40 | 0.54 | 0.017 | 0.012 | 0.24 | 11.8 | 0.016 | 0.003 | 0.016 | *3 | *5 |
| b | 0.004 | 0.04 | 0.25 | 0.03 | 0.020 | — | — | — | 0.06 | 0.011 | *3 | *6 |
| c | 0.003 | 0.02 | 0.27 | 0.005 | 0.010 | 36.2 | 0.02 | 0.016 | 0.004 | 0.001 | *3 | *7 |

#1 = kinds of plates
*2 = Fe and other inevitable impurities
*3 = rest
*4 = Note
*5 = steel plate of newly suggested material of the present invention
*6 = steel plate of low carbon plate
*7 = plate of invar alloy
a–c = kinds of metal plates Next, these metal cold-rolled steel plates were subjected to temper rolling at the processing rates shown in Table 8, respectively. Furthermore, the annealing treatment, maintained for 30 seconds after the plate temperature reaches 600° C., was performed. Thus, metal plates for shadow mask A to C were obtained.

Table 2 shows these results. Moreover, thermal strength coefficient α shown in Table 8 was an average value at 20 to 100° C.

As is apparent from the results of Table 8, metal plates for a shadow mask subjected to temper rolling and further annealing treatment at 600° C., the end-point temperature of

TABLE 8

| | | Cold rolling (*1) (%) | Annealing conditions *2 | *3 (sec) | Curvature Of warp ($mm^{-1}$) | Coefficient of thermal expansion (× $10^{-6}$/° C.) | 0.2% proof strength (MPa) Room temperature | 450 ° C. | *4 |
|---|---|---|---|---|---|---|---|---|---|
| A | A | 20 | 600 | 30 | −0.0019 | 10.5 | 545 | 435 | *5 |
| B | B | 20 | 600 | 30 | −0.0018 | 11–12 | 490 | 340 | *5 |
| C | C | 16 | 600 | 30 | −0.0020 | 2 or less | 400 | 240 | *7 |

A–C = kinds of metal plates a–c = kinds of metal plates materials

*1 = processing rates of temper rolling

*2 = reaching plate temperature

*3 = retention time

*4 = notes

*5 = newly suggested steel plate of the present invention

*6 = steel plate of low carbon

*7 = plate of invar alloy

The thus obtained metal plates A to C were subjected to half etching and then occurrence of warp was examined, respectively.

The evaluation was carried out by the following example.

First, the strip shaped test pieces of 12 mm in width×100 mm in length were cut out from the metal plates A to C. One side of the strip was sealed by fluororesin tape. Then, these test pieces were immersed in a 50° C. solution of ferric chloride having a specific gravity of 1.48 g/$cm^3$. Thereby, the surface that is not sealed with fluororesin tape was melted so that the plate thickness reached ½ (half etching). Finally, the seal on the rear side was removed and the amount of warp (curvature) of the test piece was measured.

Figure 3A:
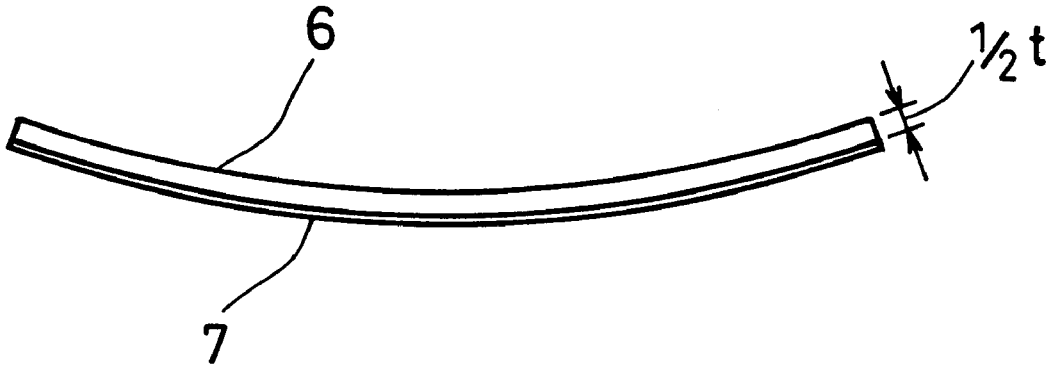
FIG. 3 is a schematic view showing a test piece in a state in which a half etching process (a process in which a metal plate is melted and removed to ½ as the thickness of the plate t) is performed in Example 4 according to the present invention.
Figure 3B:
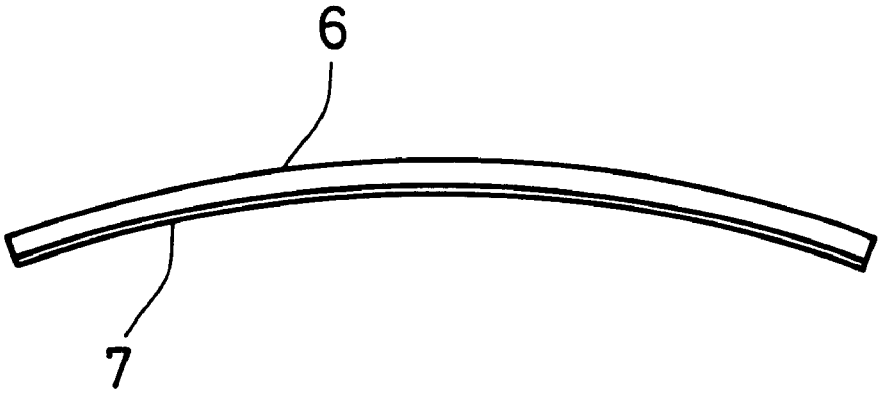

FIGS. 3A and 3B are schematic views showing various test pieces after the half etching process was performed. Depending upon the materials (namely, depending upon the internal stress accumulated to the materials), test piece after the half etching process was performed were divided into two types: the etched surface 6 having a convex curve shown in FIG. 3A and the etched surface 6 having a concave curve shown in FIG. 3B. The amount of warp was determined by measuring the curvature of the warp (inverse number of the radius of the warp). In FIGS. 3A and 3B, reference numeral 7 denotes a seal surface. After the half etching was carried out, when the etched surface becomes concave, + was marked and when the etched surface becomes convex, − was marked.

In this case, the curvature of warp was 0.003 $mm^{-1}$ or less regardless of remarks (when a test piece was hanged, warped amount was 15 mm or less per length of 100 mm), the plate had a sufficient material for practically used shadow mask.

In addition to the above, also 0.2% proof strength was examined.

the plates, in accordance with the method of the present invention shows that the amount of warp after half etching was small. Therefore, such plates were acceptable for the shadow mask.

Furthermore, it can be confirmed that the results shown in Table 8 that the stainless steel plates A of the present invention as a smaller coefficient of thermal expansion than that of a low carbon steel plate and is closer to that of a phosphor glass, 9.1 to 9.8×$10^{-6}$/° C.

Furthermore, the 0.2% proof strength of the newly suggested the steel plate A of the present invention is higher than that of a steel plate of low carbon steel plate or a steel plate of invar alloy. Furthermore, since the 0.2% proof strength also at 450° C. is high, plastic deformation does not occur even after the thermal history when the shadow mask is incorporated.

EXAMPLE 5

Steels having various chemical compositions were subjected to vacuum ingot and casting. Thereafter, the plates were subjected to hot rolling and pickling, then further cold rolling and annealing treatment repeatedly. Thus, cold-rolled steel plates each having a thickness of 0.15 mm were obtained.

Then, these plates were subjected to temper rolling so as to form into a cold-rolled steel plate having a final thickness of 0.12 mm. Furthermore, annealing treatment, retained for 30 seconds after the plate temperature reached 600° C., was performed so as to produce a thin steel plate.

TABLE 9

| | Chemical composition (weight %) | | | | | | | | | | |
|---|---|---|---|---|---|---|---|---|---|---|---|
| | C | Si | Mn | P | S | Ni | Cr | Ti | sol. Al | N | *1 |
| 1 | 0.035 | 0.40 | 0.54 | 0.017 | 0.021 | 0.24 | 0.02 | 0.011 | 0.003 | 0.020 | *2 |
| 2 | 0.028 | 0.41 | 0.52 | 0.025 | 0.025 | 0.26 | 2.4 | 0.018 | 0.004 | 0.017 | *2 |
| 3 | 0.037 | 0.44 | 0.42 | 0.024 | 0.011 | 0.23 | 6.2 | 0.016 | 0.004 | 0.014 | *2 |
| 4 | 0.030 | 0.43 | 0.52 | 0.021 | 0.024 | 0.24 | 9.1 | 0.021 | 0.004 | 0.034 | *2 |
| 5 | 0.024 | 0.40 | 0.54 | 0.017 | 0.012 | 0.24 | 11.8 | 0.016 | 0.003 | 0.016 | *2 |
| 6 | 0.046 | 0.44 | 0.56 | 0.018 | 0.014 | 0.23 | 14.6 | 0.031 | 0.003 | 0.015 | *2 |
| 7 | 0.026 | 0.43 | 0.44 | 0.017 | 0.012 | 0.19 | 18.4 | 0.019 | 0.004 | 0.024 | *2 |
| 8 | 0.031 | — | — | 0.021 | 0.018 | 0.21 | 11.9 | — | — | 0.021 | *2 |
| 9 | 0.028 | 0.46 | 0.53 | 0.018 | 0.022 | 0.24 | 11.7 | — | — | 0.018 | *2 |
| 10 | 0.046 | 0.48 | 0.48 | 0.016 | 0.024 | 0.27 | 23.4 | 0.027 | 0.003 | 0.036 | *2 |
| 11 | 0.041 | 0.43 | 0.41 | 0.019 | 0.019 | 0.22 | 27.3 | 0.016 | 0.003 | 0.031 | *2 |
| 12 | 0.039 | 0.47 | 0.54 | 0.022 | 0.016 | 0.24 | 32.1 | 0.010 | 0.004 | 0.018 | *2 |

*1 = Fe and other inevitable impurities
*2 = rest
1–12 = number of steel plates

Next, when the resultant thin steel plates (steel plates 1 to 12) were examined for the occurrence of warp after half etching was performed by the same method as in Example 4, the warp curvature of the thin steel plate was −0.002 $mm^{-1}$ or less.

Next, for each of the resultant cold-rolled steel plates (steel plates 1 to 12), the coefficient α of thermal expansion ($\times 10^{-6}$/°C.: an average value at 20 to 100° C.) was determined and at the same time, incidence of the doming phenomenon, etching property (etching processing property), and proof strength were evaluated.

Moreover, in this example, the coefficient α of thermal expansion was evaluated by the following indices as the incidence of the doming phenomenon.

○: coefficient α of thermal expansion was less than 10.7

Δ: coefficient α of thermal expansion was 10.7 or more and less than 11.0

×: coefficient α of thermal expansion was 11.0 or more

Furthermore, the etching property was evaluated by the following method.

Namely, the surface of the plate that is degreased and washed was provided with photoresist film to the thickness of 10 μm so as to form a 0.1 mm width groove pattern (M) as shown in FIG. 1. Then, an etching process was performed by spraying 50° C. solution of ferric chloride having a specific gravity of 1.48 g/$cm^3$. Then, finally, the surface photoresist film was removed. The width (W) and depth (D) of the groove etched on the steel plate were determined and the etching factor (EF) was calculated.

In this example, the etching factor when the etching depth reached 0.06 mm was calculated and the evaluated based on the following indices.

○: etching factor (EF) was 2.2 or more

Δ: etching factor (EF) was 1.8 or more and less than 2.2

×: etching factor (EF) was less than 1.8

Then, the proof strength was evaluated by the following method.

The operation in which 3% NaCl aqueous solution of 50° C. was immersed in the cold-rolled steel plate for 1 hour and then dried for 1 hour was repeated. The repeating time until the cold rolled steel plate forms rust was counted. The count value was defined as an evaluation standard of the proof strength.

In this rusting test, even if the operation of immersing and drying were repeated three times or more, if the plate does not form rust, it is judged that the plate does not have problems in terms of the proof strength. Therefore, in this example, the proof strength was evaluated based on the following indices.

○: plate formed rust, after immersing and drying was repeated 3 or more times.

×: plate formed rust after immersing and drying was repeated less than 3 times.

Table 10 shows the resulting evaluation.

TABLE 10

| | | Coefficient of thermal expansion | | Etching property | | Proof strength | |
|---|---|---|---|---|---|---|---|
| | | Coefficient of thermal expansion α ($\times 10^{-6}$/° C.) | Evaluation | EF | Evaluation | Repeating time | Evaluation |
| 1 | (1) | 11.5 | x | 2.6 | ○ | 1 | x |
| 2 | (2) | 11.3 | x | 2.6 | ○ | 1 | x |
| 3 | (3) | 10.9 | Δ | 2.5 | ○ | 2 | x |
| 4 | (4) | 10.6 | ○ | 2.4 | ○ | 4 | ○ |
| 5 | (5) | 10.5 | ○ | 2.3 | ○ | 4 | ○ |
| 6 | (6) | 10.4 | ○ | 2.3 | ○ | 5 | ○ |
| 7 | (7) | 10.4 | ○ | 2.1 | ○ | 7 | ○ |

TABLE 10-continued

| | | Coefficient of thermal expansion | | Etching property | | Proof strength | |
|---|---|---|---|---|---|---|---|
| | | Coefficient of thermal expansion α (× $10^{-6}$/° C.) | Evaluation | EF | Evaluation | Repeating time | Evaluation |
| 8 | (8) | 10.6 | ○ | 2.4 | ○ | 4 | ○ |
| 9 | (9) | 10.6 | ○ | 2.3 | ○ | 4 | ○ |
| 10 | (10) | 10.3 | ○ | 1.9 | Δ | 10 or more | ○ |
| 11 | (11) | 10.4 | ○ | 1.7 | x | 10 or more | ○ |
| 12 | (12) | 10.4 | ○ | 1.5 | x | 10 or more | ○ |

1–12 = kinds of steel plates
(1)–(12) = kinds of steels

As is apparent from the result shown in Table 4, the stainless steel plates (plate 4 to 9) of the present invention have coefficient of thermal expansion closer to that of the phosphor glass and excellent etching property (etching factor EF) and proof strength. The result shows that the plates of the present invention are suitable materials for a shadow mask.

EXAMPLE 6

Steels having chemical compositions shown in Table 11 were subjected to vacuum ingot, respectively. These steels were cast and subjected to hot rolling and pickling, then further subjected to cold rolling and annealing treatment repeatedly. Thus, cold-rolled steel plates each having a thickness of 0.15 mm thickness were obtained.

TABLE 11

| Chemical components (weight %) | | | | | | | | | |
|---|---|---|---|---|---|---|---|---|---|
| C | Si | Mn | P | S | Cr | Ti | sol. Al | N | *1 |
| 0.024 | 0.40 | 0.54 | 0.017 | 0.012 | 11.8 | 0.016 | 0.003 | 0.016 | rest |

*1 = Fe and other inevitable impurities

Then, the plate was subjected to temper rolling so as to form 0.12 mm thick cold-rolled steel plates. Therefore, the shapes of the cold-rolled steel plates were corrected by bending and restoring with tension applied.

Next, a plurality of the shape-corrected steel plates were heated to each temperature shown in Table 12 and maintained for 30 seconds at the temperature. Thus, the annealing treatment was performed.

First, the strip shaped test pieces of 12 mm in width×100 mm in length were cut out of the metal plates after the annealing treatment was performed. One side of the strip-shaped test piece was sealed with a fluororesin tape. Then, this test piece was immersed in a 50° C. solution of ferric chloride having a specific gravity of 1.48 g/$cm^3$. Thereby, the surface being not sealed with fluororesin tape was dissolved so that the plate thickness reached ½ (half etching). Finally, the seal on the rear side was removed and the warp (curvature) of the test pieces was measured.

Furthermore, for each steel plate after annealing treatment was performed, also Vickers hardness (load 100 g) at the cross section of the steel plate was measured as the representative value of the mechanical property.

These values are also set forth in Table 12 along with the measurement value of steel plate after temper rolling and the measurement value of the steel plate after the shape correction was performed.

TABLE 12

| | Steel plates to be tested | Annealing conditions: End point temperature (° C.) | Retention time (sec) | Curvature of warp ($mm^{-1}$) | Vickers hardness (Hv 100 g) |
|---|---|---|---|---|---|
| A | | | | | |
| 1 | *steel plate 1 | — | — | −0.0167 | 211 |
| 2 | *steel plate 2 | — | — | +0.0613 | 210 |
| 3 | Steel plate | *500 | 30 | +0.0311 | 208 |
| 4 | after | *520 | 30 | +0.0083 | 205 |
| B | annealing | | | | |
| 5 | treatment | 550 | 30 | +0.0030 | 202 |
| 6 | | 580 | 30 | +0.0024 | 201 |
| 7 | | 600 | 30 | +0.0018 | 201 |
| 8 | | 650 | 30 | +0.0012 | 200 |
| C | | | | | |
| 9 | | *680 | 30 | +0.0005 or less | 186 |
| 10 | | *730 | 30 | +0.0005 or less | 164 |

*the conditions are out of the conditions of the present invention.
Steel plate 1 = steel plate after temper rolling
Steel plate 2 = steel plate after shape correction
A = Comparative Examples
B = Examples of the present invention
C = Comparative Examples
1–12 = number of steel plates It is confirmed from the results shown in Table 12 that warp occurs remarkably both in the steel plate subjected to temper rolling and the steel plate subjected to a shape correction after the half etching treatment was performed. In particular, the shape of warp due to the shape correction was reversed from concave shape (−) to convex shape (+), and the absolute value of the warp amount radically increased.

The following points are also shown, when the resultant values in Table 6 were considered, taken the fact that the curvature of warp was 0.003 $mm^{-1}$ or less regardless of remarks (when a test piece was hanged, it was warped 15 mm or less per length of 100 mm), the steel plate had a sufficient level for serving as the stainless plate for a shadow mask.

Namely, when the amount of warp was reduced by annealing the shape-corrected steel plate. However, when the annealing temperature as the end-point temperature was less than 550° C., the shape stability of the resultant steel plate does not reach to the practically acceptable level.

On the other hand, when the annealing temperature as the end-point temperature was in the range from 550 to 650° C., the amount of warp after etching falls within the practically acceptable level.

On the other hand, when the annealing temperature as the end-point temperature is more than 650° C., the amount of warp after etching treatment is extremely small. However, the Vickers hardness was extremely reduced, and thus the mechanical strength is not acceptable.

INDUSTRIAL APPLICABILITY

As mentioned above, the present invention can provide a stainless steel plate for a shadow mask, in which the coefficient of thermal expansion is smaller than that of the conventionally used low carbon steel plate material, mechanical strength is excellent, doming phenomenon does not occur easily, fine etching process can be performed excellently and the cost is relatively low.

Furthermore, according to the method of the present invention, it is possible to provide a metal plate for a shadow mask that is excellent in shape stability without warp occurrence after an etching process is performed at low cost and stably. Furthermore, it is also possible to provide stably a metal plate for a shadow mask in which the coefficient of thermal expansion is smaller than that of a low carbon steel and the cost is less expensive than invar alloy, and plastic deformation at high temperature is small, strength is high, and etching property and the shape stability after etching are excellent.

What is claimed is:

1. A shadow mask comprising a stainless steel plate comprising a plurality of slot holes having a substantially rectangular shape and having a constant longitudinal pitch along a vertical direction, wherein the stainless steel comprises 9 to 20 weight % of chromium (Cr), 0.15 weight % or less of carbon (C), manganese (Mn) in an amount no greater than 1.0 weight %, titanium (Ti) in an amount no greater than 0.2 weight %, 0 to 1.0 weight % of silicon (Si), and 0 to 1.0 weight % of aluminum (Al); wherein the rest includes iron (Fe) and inevitable impurities comprising phosphorous (P) in an amount of 0.05 weight % or less and sulfur (S) in an amount of 0.03 weight % or less.

2. The shadow mask according to claim 1, wherein the stainless steel comprises 9 to 13 weight % of chromium (Cr).

3. The shadow mask according to claim 1, wherein the stainless steel comprises 0.003 to 0.05 weight % carbon (C).

4. The shadow mask according to claim 1, wherein the stainless steel plate for the shadow mask is subjected to annealing at an end-point temperature of 550 to 650° C. after cold rolling or shape correction.

5. The shadow mask according to claim 4, wherein the annealing temperature is 600 to 650° C.

6. The shadow mask according to claim 4, wherein the annealing time is 30 seconds to 10 minutes.

7. A method for producing a shadow mask comprising:

forming a stainless steel plate comprising a plurality of slot holes having a substantially rectangular shape and having a constant longitudinal pitch along a vertical direction, wherein the stainless steel comprises 9 to 20 weight % of chromium (Cr), 0.15 weight % or less of carbon (C), manganese (Mn) in an amount no greater than 1.0 weight %, titanium (Ti) in an amount no greater than 0.2 weight %, 0 to 1.0 weight % of silicon (Si), and 0 to 1.0 weight % of aluminum (Al); wherein the rest includes iron (Fe) and inevitable impurities comprising phosphorous (P) in an amount of 0.05 weight % or less and sulfur (S) in the amount of 0.03 weight % or less; cold rolling or shape correcting the stainless steel plate; and annealing the stainless steel plate at an end-point temperature of 550 to 650° C.

8. The method according to claim 7, wherein the annealing temperature is 600 to 650° C.

9. The method according to claim 7, wherein the annealing time is 30 seconds to 10 minutes.

10. The method according to claim 7, wherein the annealing is performed in a bright annealing furnace.

11. The method according to claim 7, wherein the stainless steel comprises 9 to 13 weight % of chromium (Cr).

12. The method according to claim 7, wherein the stainless steel comprises 0.003 to 0.05 weight % carbon (C).

* * * * *